US006019544A

United States Patent [19]

Emerson et al.

[11] Patent Number: 6,019,544

[45] Date of Patent: Feb. 1, 2000

[54] EDGE COMPACTING DEVICE FOR AN ASPHALT PAVER

[75] Inventors: David Emerson, San Antonio, Tex.; Joseph E. Musil, Ely, Iowa

[73] Assignee: Cedarapids, Inc., Cedar Rapdis, Iowa

[21] Appl. No.: 09/045,751

[22] Filed: Mar. 20, 1998

[51] Int. Cl.[7] ..... E01C 19/30

[52] U.S. Cl. ..... 404/104; 404/118; 404/133.05

[58] Field of Search ..... 404/118, 133.05, 404/133.1, 133.2, 102, 103, 104

[56] References Cited

U.S. PATENT DOCUMENTS

| | | | |
|---|---|---|---|
| 1,986,138 | 1/1935 | Creason | 404/133.1 |
| 4,379,653 | 4/1983 | Brown | 404/118 |
| 4,489,658 | 12/1984 | Beckmann | 104/12 |
| 4,502,813 | 3/1985 | Hojberg | 404/102 |
| 4,818,140 | 4/1989 | Carlson | 404/118 |
| 4,828,428 | 5/1989 | Anderson | 404/105 |
| 5,213,442 | 5/1993 | Sovik | 404/133.05 |

*Primary Examiner*—Thomas B. Will
*Assistant Examiner*—Kristine M Markovich
*Attorney, Agent, or Firm*—Marshall, O'Toole, Gerstein, Murray & Borun

[57] ABSTRACT

An asphalt paver for applying a mat of asphalt material as the paver is moved along a path includes a frame, a compacting screed having rotatable vibrator shaft, and an edge compactor attached to the outer end of the compacting screed. The edge compactor includes a pivoting nose piece or tamping bar having an outer end generally overlying an edge portion of the asphalt mat, a rotatable shaft connected to the vibrator shaft, and a rod eccentrically mounted to the rotatable shaft and secured to the tamping bar outer end for pivoting the tamping bar in response to rotation of the rotatable shaft. The oscillating movement of the tamping bar over the outer edge of the asphalt mat compacts the edge of the asphalt mat as the paver is moved along the path.

35 Claims, 8 Drawing Sheets

EDGE COMPACTING DEVICE FOR AN ASPHALT PAVER

FIELD OF THE INVENTION

The present invention relates generally to asphalt pavers. More specifically, the present invention relates to a device for pre-compacting the edges of asphalt mats in order to reduce the failure of the longitudinal joint between adjacent mats of asphalt.

BACKGROUND OF THE INVENTION

Most asphalt paving machines are of the "floating screed" type in which asphaltic material is distributed in front of a screed as the paver is moved over the ground. The screed floats on the asphalt and compresses the asphalt material into a mat. The texture and density of the asphalt mat are influenced by a number of factors, including the weight of the screed assembly and the angle of the screed assembly relative to the ground. Some screed assemblies also include a rotating shaft, having a series of counterweights, which vibrates the screed and further compacts the asphalt.

The width of the asphalt mat is generally limited to the width of the paving machine, although in some instances the width may be increased by using extended screeds. Nevertheless, in most paving applications, such as two lane roadways, the paver must make at least two passes. When paving wider roads or parking lots, the paver must typically make a number of passes in order to apply an asphalt mat of the desired width. Each time the paver makes an additional pass, a longitudinal joint is created between the two passes. Unfortunately, these longitudinal joints are frequently the first point of failure.

The edges of the pavement mat, especially the edges of the first pass, are usually less compacted than the center section due to the fact that the edges are generally unconfined as the asphalt is applied. These low density areas may include air voids and are especially vulnerable to the ingress of water and/or road salt, all of which leads to degradation of the joint and eventual pavement failure. In some circumstances the edge of the pavement will collapse under the weight of the compacting roller, especially when the edge is unconfined. Poor longitudinal joint quality is the most frequent cause of expensive repairs, and in many instances repair may not be feasible and the entire application must be re-paved.

Accordingly, there exists a need to improve compaction of the asphalt mat, with special focus on the edge of the mat, in order to reduce the occurrence of longitudinal joint failure.

SUMMARY OF THE INVENTION

An edge compacting device for an asphalt paver incorporating the features of the present invention greatly reduces if not eliminates failure of the longitudinal joint on adjacent mats of asphalt pavement, and significantly extends the service life of asphalt pavement applications. The present edge compacting device can be readily adapted to existing paving machines, and can be used with standard screeds or screed extensions. Alternatively, the edge compacting device may be built into the screed structure itself.

According to one aspect of the invention, an edge compacting device for attachment to the screed of an asphalt paver is disclosed. The paver preferably includes a drive system and is adapted to apply a mat of asphalt material as the paver is moved along a path. The edge compacting device comprises a member for attachment to the screed, a tamping bar having an inner end attached to the member by a pivot, and an outer end generally overlying an edge portion of the asphalt mat. An actuator is operatively connected to the paver drive system, and the actuator is connected to the tamping bar outer end in order to oscillate or pivot the tamping bar about the pivot in response to operation of the drive system, thereby compacting the edge portion of the asphalt mat as the paver is moved along the path.

The axis of the pivot is generally parallel to the path of the paver. The actuator includes a rotatable shaft, which may be connected to the screed vibrator shaft of the paver, and a connecting rod which connects the tamping bar to the rotatable shaft. The connecting rod has a first end pivotally and eccentrically connected to the rotatable shaft, preferably by a heim joint or a ball joint, and has a second end connected to the tamping bar outer end, again preferably by a heim joint or a ball joint. The heim or ball joints preferably include roller bearing elements for smooth operation. The connecting rod reciprocates in response to rotation of the rotatable shaft, thus pivoting the tamping bar about the pivot. The eccentric connection that secures the connecting rod to the rotatable shaft is adjustable, so that the tamping bar has an adjustable stroke or "throw."

The tamping bar preferably is attached to the leading edge of the screed extension, and the tamping bar and the screed extension each have a generally planar bottom surface. The bottom surface of the tamping bar is shiftable between a raised position disposed above the screed bottom surface and a lowered position disposed below the screed bottom surface.

Preferably, the inner portion of the edge compacting device is adapted to be attached directly to a standard screed. A retention plate is adapted to be attached to the outer portion of the member. The retention plate serves to confine uncompacted asphalt, thereby better defining the edge of the asphalt mat leading to better edge compaction.

According to another aspect of the invention, an asphalt paver for applying a mat of asphalt material comprises a frame, a compacting screed attached to the frame and having an outer end, and a screed extension attached to the screed outer end. The screed extension includes a pivoting tamping bar having an outer end generally overlying an edge portion of the asphalt mat. Means are provided which engage the tamping bar for pivoting the tamping bar about a pivot axis, thereby compacting the outer edge of the asphalt mat as the paver is moved along the path.

According to yet another aspect of the invention, an asphalt paver for applying a mat of asphalt material as the paver is moved along a path, comprises a frame and a compacting screed attached to the frame. The compacting screed has a rotatable vibrator shaft. An edge compactor is attached to an outer end of the compacting screed, and the edge compactor includes a pivoting tamping bar having an outer end generally overlying an edge portion of the asphalt mat, a rotatable shaft connected to the screed vibrator shaft, and a connecting rod eccentrically mounted to the rotatable shaft and secured to the tamping bar outer end for pivoting the tamping bar in response to rotation of the rotatable shaft. The edge compactor thereby compacts the outer edge of the asphalt mat as the paver is moved along the path.

According to a still further aspect of the invention, a screed extension for attachment to the screed of an asphalt paver comprises a rigid frame member attached to the paver screed, a rotatable shaft extending into the frame member and being connected to a drive system, and a nose piece attached to a front end of the frame member by a pivot. The nose piece includes an outer end generally overlying an edge portion of the asphalt mat. A connecting rod is eccentrically mounted to the rotatable shaft and is secured to the nose piece outer end for pivoting the nose piece in response to rotation of the rotatable shaft. The edge compactor thereby compacts the outer edge of the asphalt mat as the paver is moved along the path.

Other objects, features and advantages of the present invention will become readily apparent to those skilled in the art upon a reading of the following claims.

DETAILED DESCRIPTION OF THE INVENTION

The following embodiments have been chosen and described in order to best explain the principles of the invention so that others skilled in the art may follow its teachings.

Figure 1:
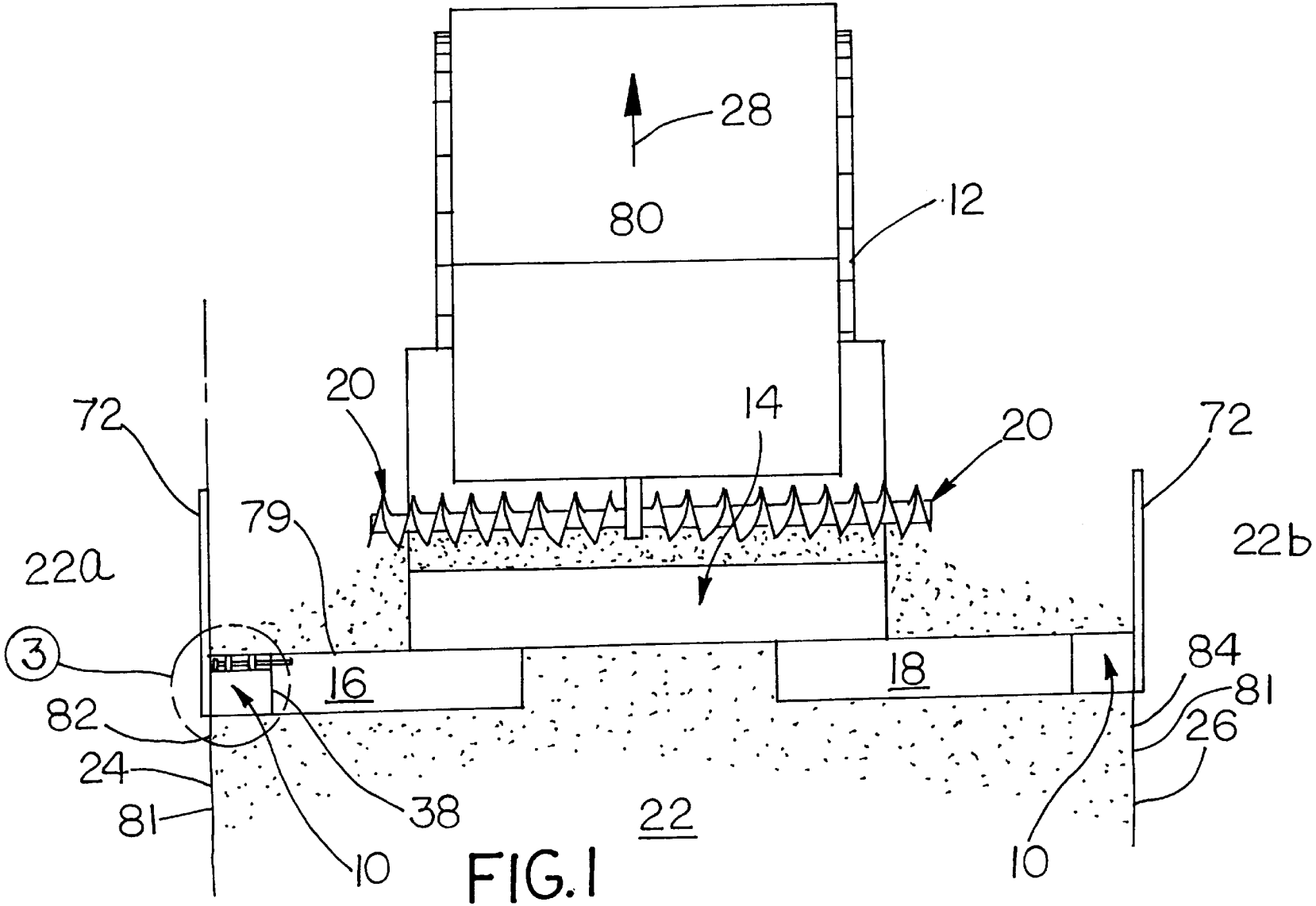
FIG. 1 is a diagrammatic top plan view of an asphalt paver having an edge compacting device according to the present invention shown proceeding over the ground and applying a mat of asphaltic material.

Referring now to the drawings, an edge compacting device incorporating the features of the present invention is generally referred to by the reference numeral 10 and is shown attached to an asphalt paver 12. The asphalt paver 12 preferably includes a compacting screed assembly 14 having a pair of screed extension 16, 18 and an auger assembly 20 for spreading asphalt material laterally in front of the screed assembly 14, so that asphalt from the paver can be spread and compressed into a mat 22 having a pair of edges 24, 26 as the paver is moved along a path 28. The paver 12 preferably includes a drive system operatively connected to a rotatable vibrator shaft 30 (FIG. 3) extending through parts of the screed assembly 14 for vibrating the screed assembly 14 as is well known in the art. As can be seen in FIG. 1, it will be understood that the asphalt paver 12 will typically include the edge compacting device 10 adjacent to and generally overlying both of the edges 24, 26 of the mat 22. However, for the sake of convenience only a single such edge compacting device 10 will be discussed in detail. In this case the edge compacting device 10 on the left side of the paver 12 will be described, with the edge compacting device on the right side of the paver 12 being a mirror image of the left side edge compacting device.

Referring now to FIGS. 2 through FIG. 6, the edge compacting device 10 includes a frame member 32 having inner and outer edges 34, 36. The frame member 32 is adapted to be attached to the adjacent outer end 38 of the adjacent screed extension 16 in a conventional manner. As shown to advantage in FIG. 3, the leading edge of the member 32 includes a nose piece or tamping bar 40 which is attached to a forward portion 42 of the member 32 by a pivot assembly 44. The pivot assembly is disposed generally adjacent an inner edge 46 of the tamping bar 40, while an outer edge 48 of the tamping bar 40 generally overlies, and helps to define, the edge 24 of the asphalt mat 22.

Figure 5:
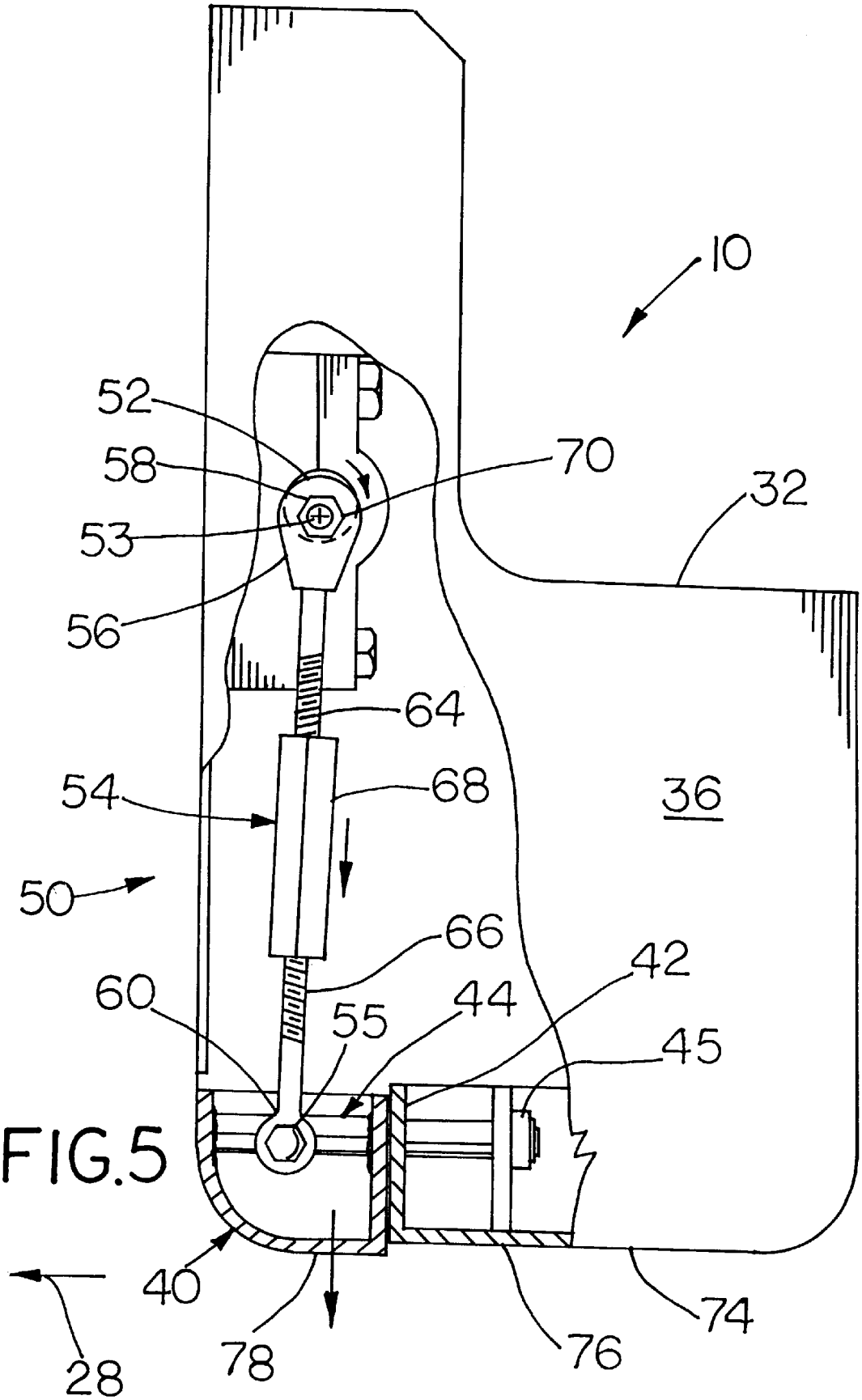
FIG. 5 is an elevational view similar to FIG. 4 but showing the tamping bar in the lowered position below the elevation of the screed.
Figure 6:
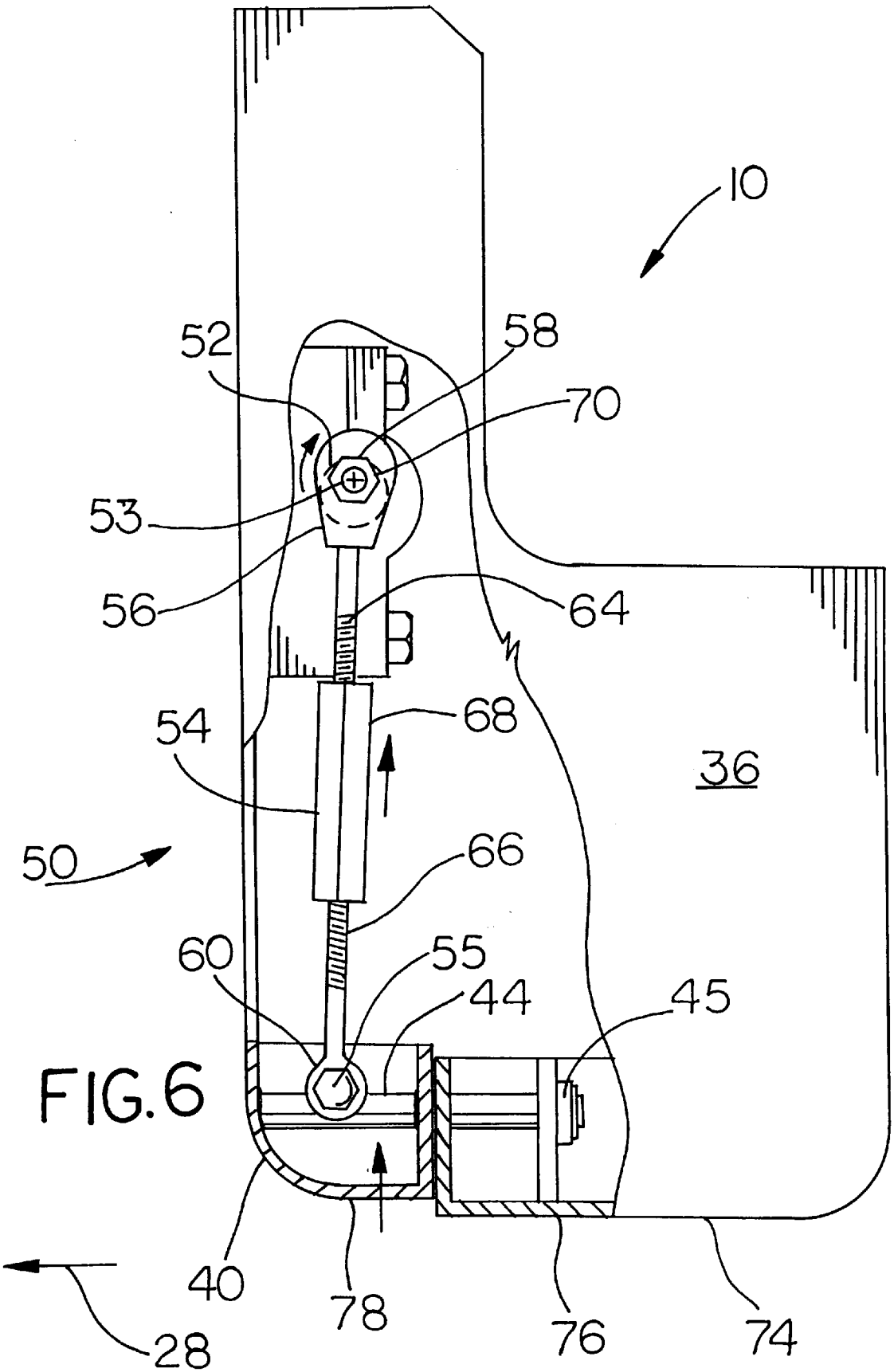
FIG. 6 is an elevational view similar to FIGS. 4 and 5 but showing the tamping bar in the raised position above the elevation of the screed.

An actuation assembly 50 is provided for pivoting or oscillating the tamping bar 40 about the pivot assembly 44, which permits the outer end 48 of the tamping bar to be shifted between a lowered position as shown in FIG. 5 and a raised position as shown in FIG. 6. The pivot assembly 44 may be disassembled by removing, for example, a retaining nut 45, so that the tamping bar 40 may be removed. In the embodiment shown, the actuation assembly includes a rotating shaft 52 which is connected to an offset portion 53 of the shaft 52. A connecting rod 54 connects the shaft 52 to a lug 55 at the outer end 48 of the tamping bar 40. Accordingly, the outer end of the tamping bar 40 oscillates or pivots about the pivot assembly 44 in response to rotation of the shaft 52. It will be noted that in the embodiment shown, the axis of the pivot assembly 44 is generally parallel to the path 28 of the paver 12. The connecting rod 54 includes an upper end 56 attached to the shaft 52 by an eccentric connection 58, and further includes a lower end 60 connected to the outer end 48 of the tamping bar 40 by a connection 62. Preferably, connections 58 and 62 are ball joints, heim joints, or other suitable connections that will provide two degrees of freedom at the point of connection. Connecting rod 54 preferably includes a pair of oppositely pitched threaded portions 64, 66, which are joined by an adjuster 68 so that the length of the rod 54 can be adjusted. Connection 58 also includes an adjuster 70, so that the stroke or "throw" of the tamping bar 40 can be adjusted. It is contemplated that other means may be provided for oscillating the tamping bar 40. For example, the shaft 52 could include a raised cam or lobe, with the upper end 56 including a cam follower. Alternatively, the pivoting motion of the tamping bar 40 could be gear driven.

Figure 2:
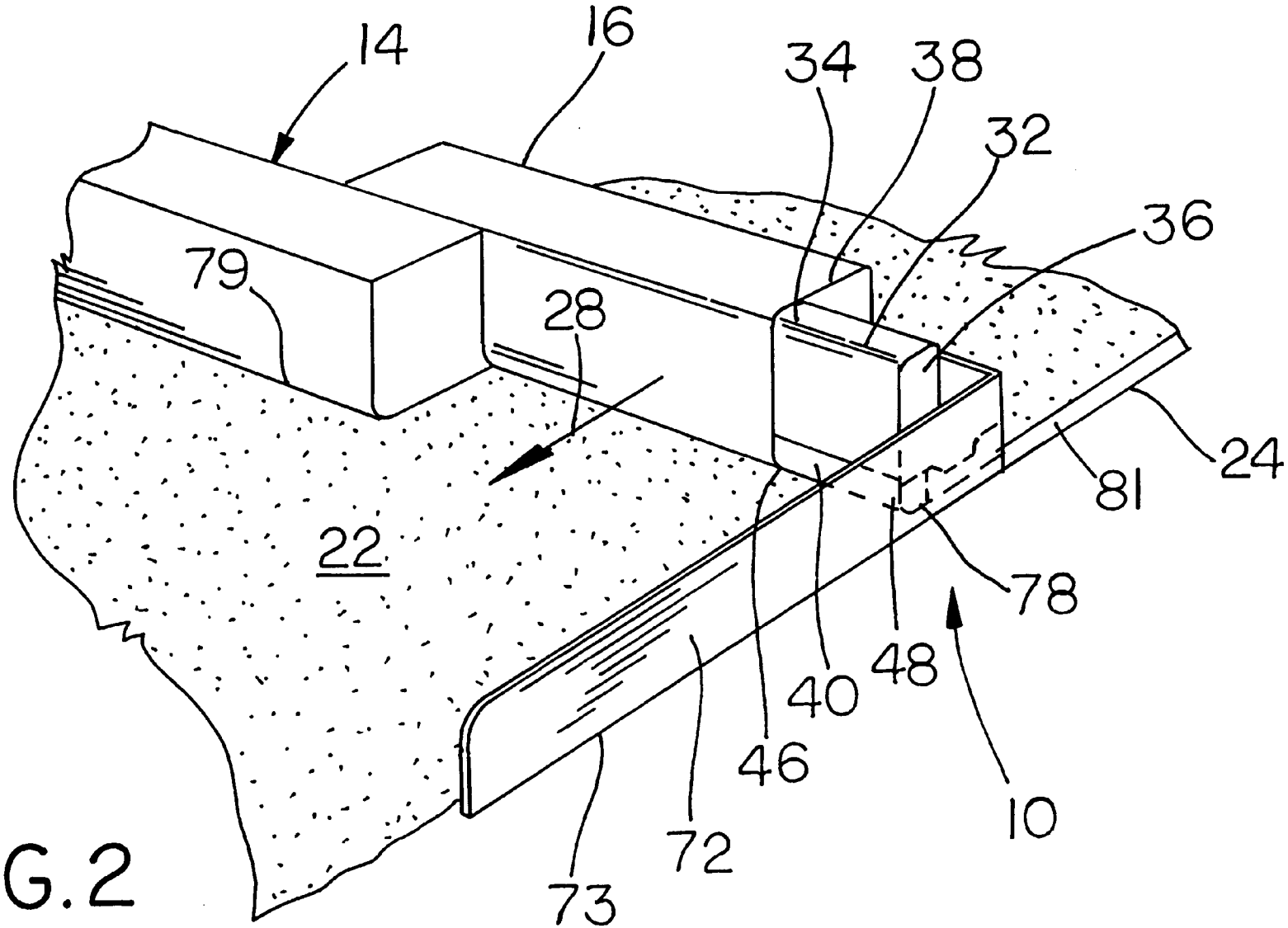
FIG. 2 is an enlarged fragmentary view in perspective of the circumscribed portion of FIG. 1.

As shown in FIGS. 1 and 2, a retention plate 72 is attached to the outer end 36 of the member 32 using bolts or other conventional fasteners. The retention plate 72 includes a bottom edge 73. A system of rollers or guides (not shown) may be attached to the bottom edge 73 to guide the edge 73 over the ground. The retention plate 72 extends in front of the leading edge of the screed assembly 14 or the screed extension 16 in a direction generally parallel to the path 28, and thus prevents any asphalt material from being pushed past the desired edge 24. Accordingly, the retention plate 72 helps to define the edge 24 of the mat 22.

As shown in FIGS. 3 through 6, the member 32 of the edge compacting device 10 includes a generally planar bottom surface 74, which preferably is generally coplanar with a bottom surface 76 of the adjacent screed extension 16. The tamping bar 40 also includes a planar portion 78, which at times is above, coplanar with, or below the bottom surface 76 as the shaft 52 rotates, as will be discussed in greater detail below.

In operation, the paver 12 is moved along a path in a conventional manner, either under its own power or with the assistance of a towing vehicle (not shown). Asphalt material is conveyed from a hopper portion 80 of the paver by a conventional system (not shown), and is laterally distributed in front of the screed assembly 14 by the auger assembly 20. The auger assembly 20 distributes the asphalt material in front of the screed assembly 14, so that the asphalt material will fall under the leading edge 79 of the screed assembly 14 for compression into the mat 22. It will be noted that the pivot axis of the pivot assembly 44 may be declined slightly, so that the tamping bar 40 "tucks" material under the leading edge 79 of the screed assembly.

Figure 3:
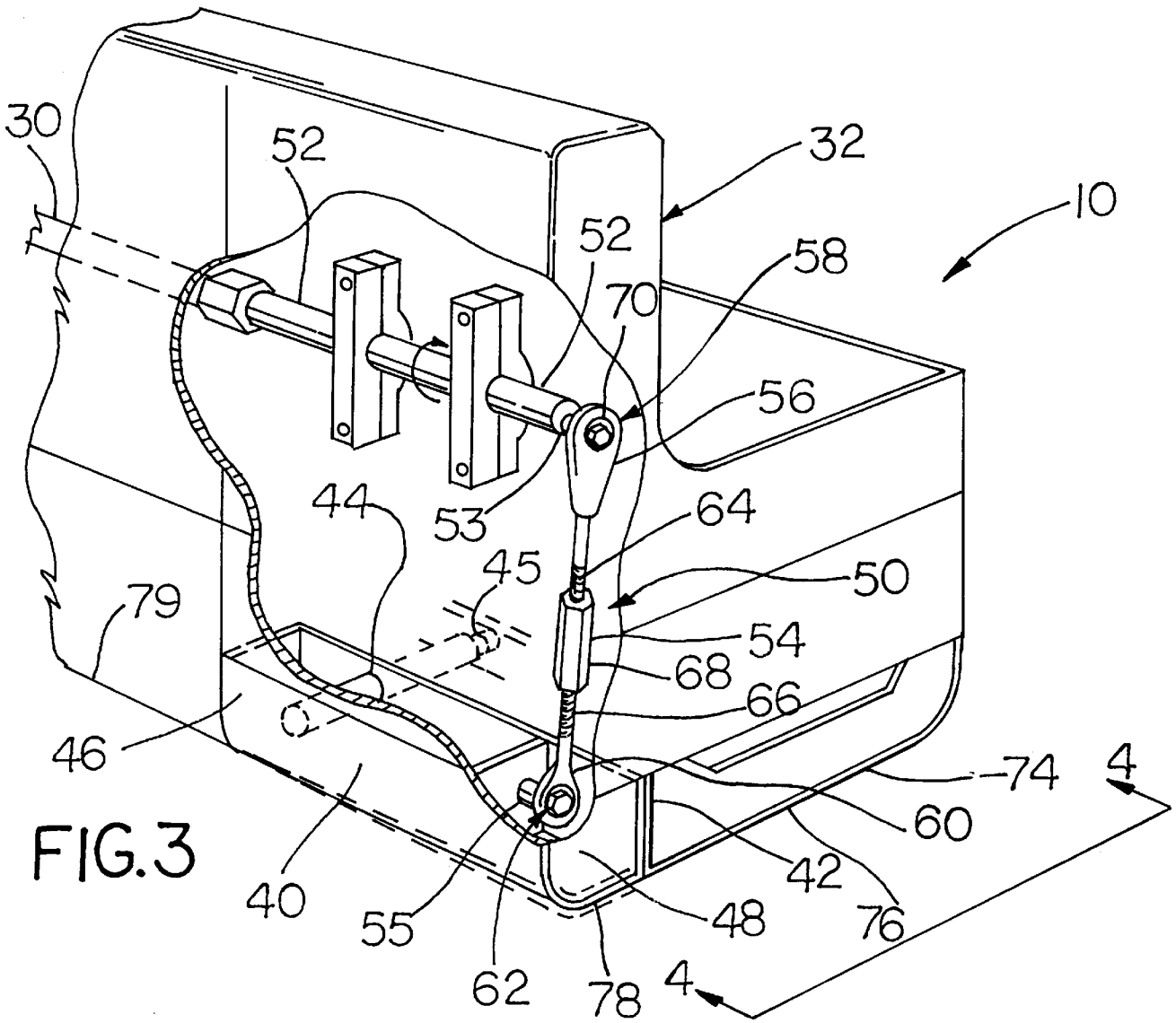
FIG. 3 is a fragmentary view in perspective, similar to FIG. 2, but showing a portion of the device cut away to reveal the rotatable shaft and the connecting rod.
Figure 4:
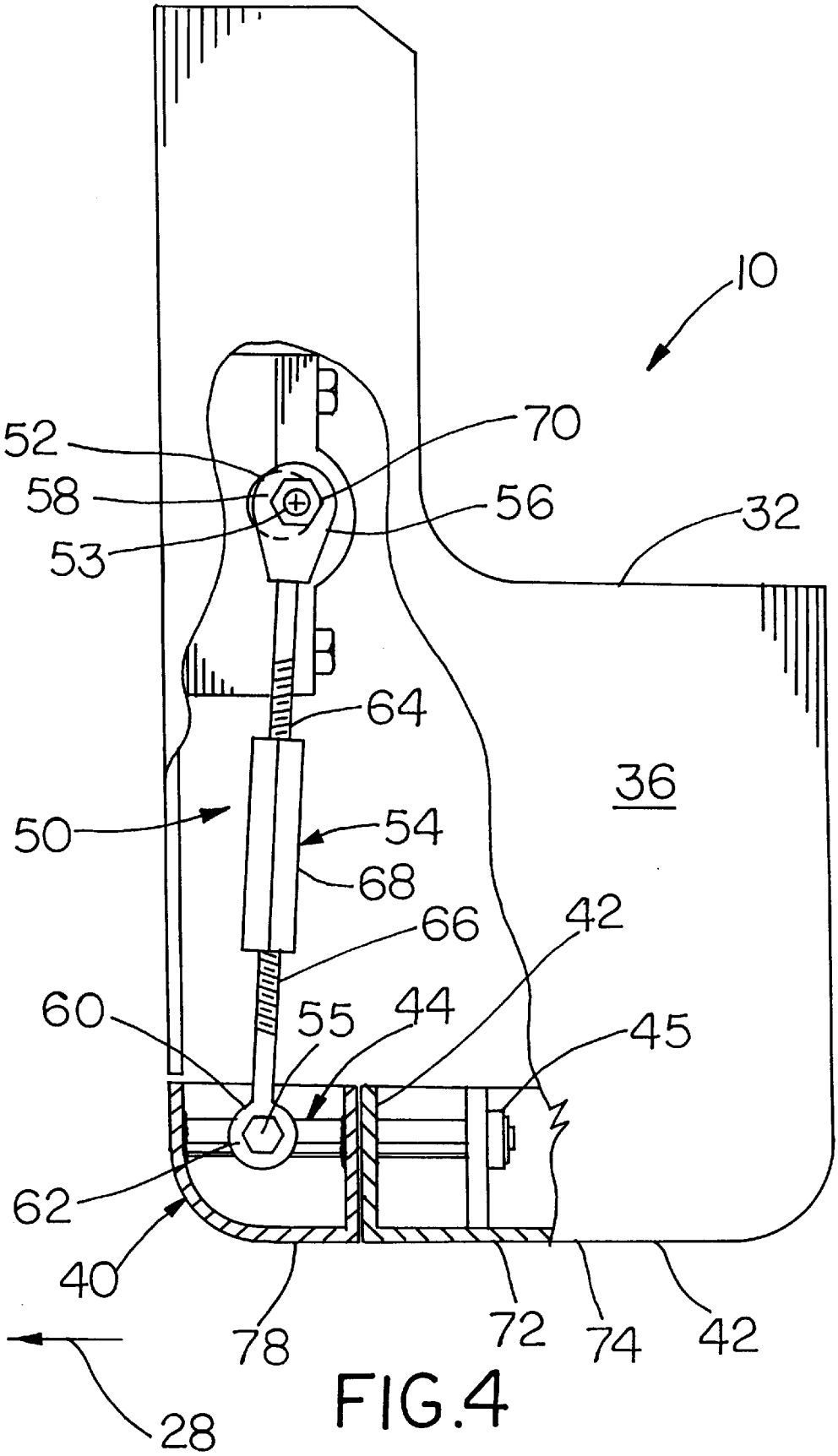
FIG. 4 is a fragmentary elevational view taken along lines 4—4 of FIG. 3 illustrating the front tamping bar or nose piece connected to the rotatable shaft.
Figure 7:
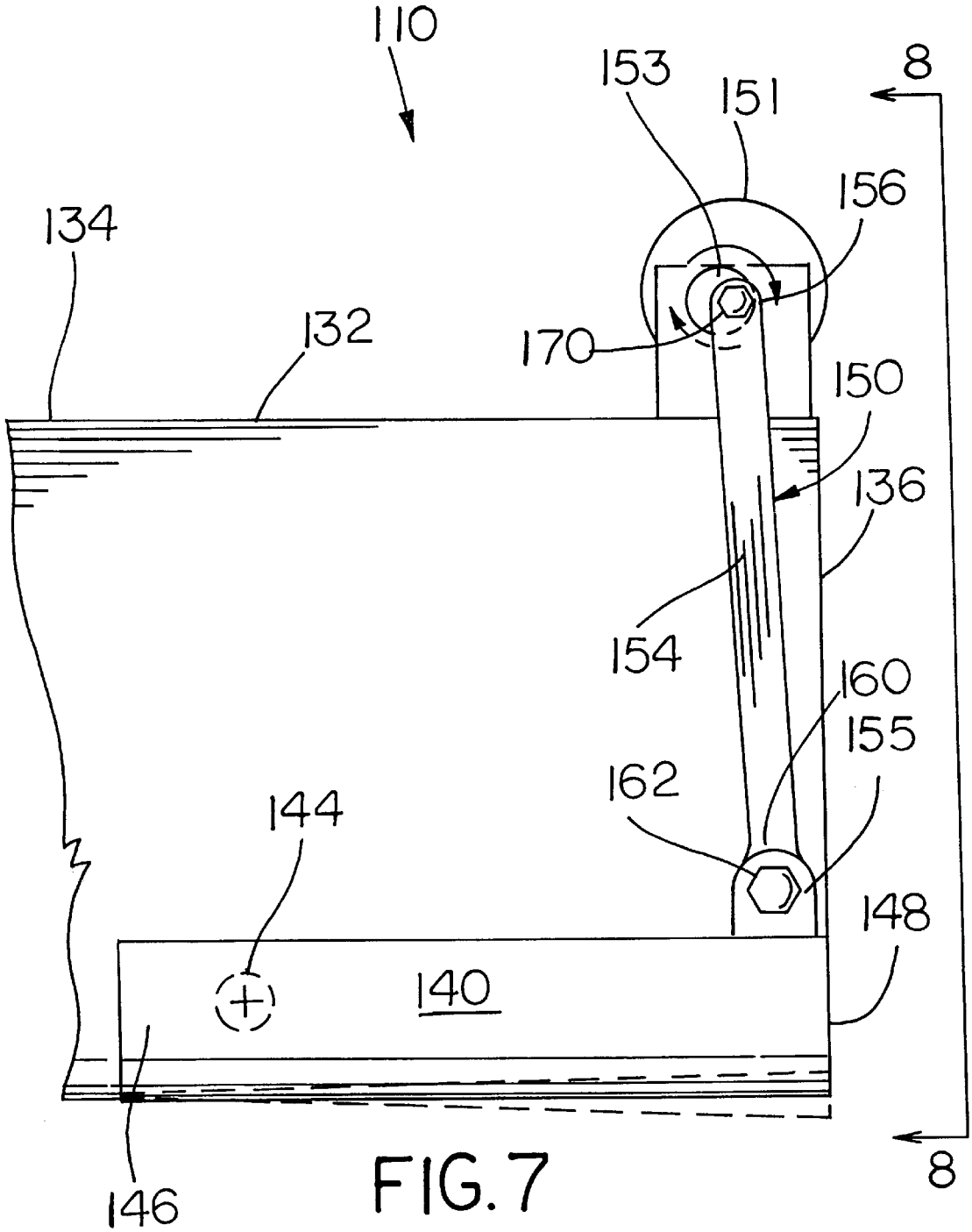
FIG. 7 is a fragmentary front elevational view illustrating an alternate embodiment for the present invention.

As the paver 12 proceeds along the path 28, the drive system powers the rotatable vibrator shaft 30, which helps to compress the asphalt material into the mat 22. As shown in FIG. 3, the shaft 52 is connected to the vibrator shaft 30, so that the shafts 30 and 52 rotate in tandem. As the shaft 52 rotates, the connecting rod 54 reciprocates up and down by virtue of the eccentric connection 52 at the upper end 56 of the connecting rod 54 as can be seen in FIGS. 5 through 7. Consequently, the planar bottom surface 78 of the tamping bar 40 shifts from the lowered position of FIG. 5, in which the bottom surface 78 is below the bottom surfaces 74, 76 of the member 32 of the screed assembly 14, to a raised position above the bottom surfaces 74, 76 of the member 32 or the screed assembly 14. In the process, the bottom surface 78 of the tamping bar 40 compacts, or pre-compacts, the asphalt material adjacent the edge 24 of the asphalt mat 22.

Although the outer end 48 of the tamping bar 40 travels along an arcuate path, the ball joints at connections 58 and 62 will prevent any binding between the rod 54 and either of the shaft 52 or the lug 55 at the outer end 48 of the tamping bar 40. Accordingly, the tamping bar 40 at all times pivots freely about the pivot assembly 44. The length of the connecting rod 54 can be increased or decreased simply by turning the adjuster 68, which cooperates with the threaded portions 64, 66 to alter the effective length of the connecting rod 54. The stroke or "throw" of the connecting rod 54 can be adjusted using the adjuster 53 to shorten or lengthen the connecting rod 54. Preferably, the outer end 48 of the tamping 40 will have a stroke, throw, or range of motion of approximately 5/8ths of an inch (5/16ths of an inch upwardly and 5/16ths of an inch downwardly from the mean elevation). The range of motion may be increased or decreased using the adjuster 53 and/or the adjuster 68.

As shown in FIG. 2, the oscillating tamping bar 40 works in conjunction with the retention plate 72 to define a zone of increased asphalt compaction generally adjacent the edge 24 of the mat 22. The tamping bar 40 works to compress the material downwardly as well as toward the retention plate 72, so that the edge 24 of the mat 22 is highly compacted and forms a well compacted and well defined vertical edge portion 82 on the mat 22. When an adjacent mat of asphalt is applied next to the mat 22, a longitudinal joint 82, 84 will be formed extending along the edges 24, 26, respectively, of the mat 22. For example, a mat applied to the area designated as 22*a* to the left of FIG. 1 will form longitudinal joint 82, while a mat applied to the area designated 22*b* to the right of FIG. 1 will form the longitudinal joint 84. Consequently, when either of the adjacent mats 22*a* or 22*b* is applied, the edges of those respective mats will abut up against the compacted vertical edge portion 81 along the edge 24 or 26 of the mat 22. Note that the retention plate may be omitted between the mats. The edges of the mats will be confined by the compressed and compacted edges at 24 and/or 26, and thus all of the asphalt in the region of the longitudinal joints 82 and 84 will be fully compacted.

Figure 8:
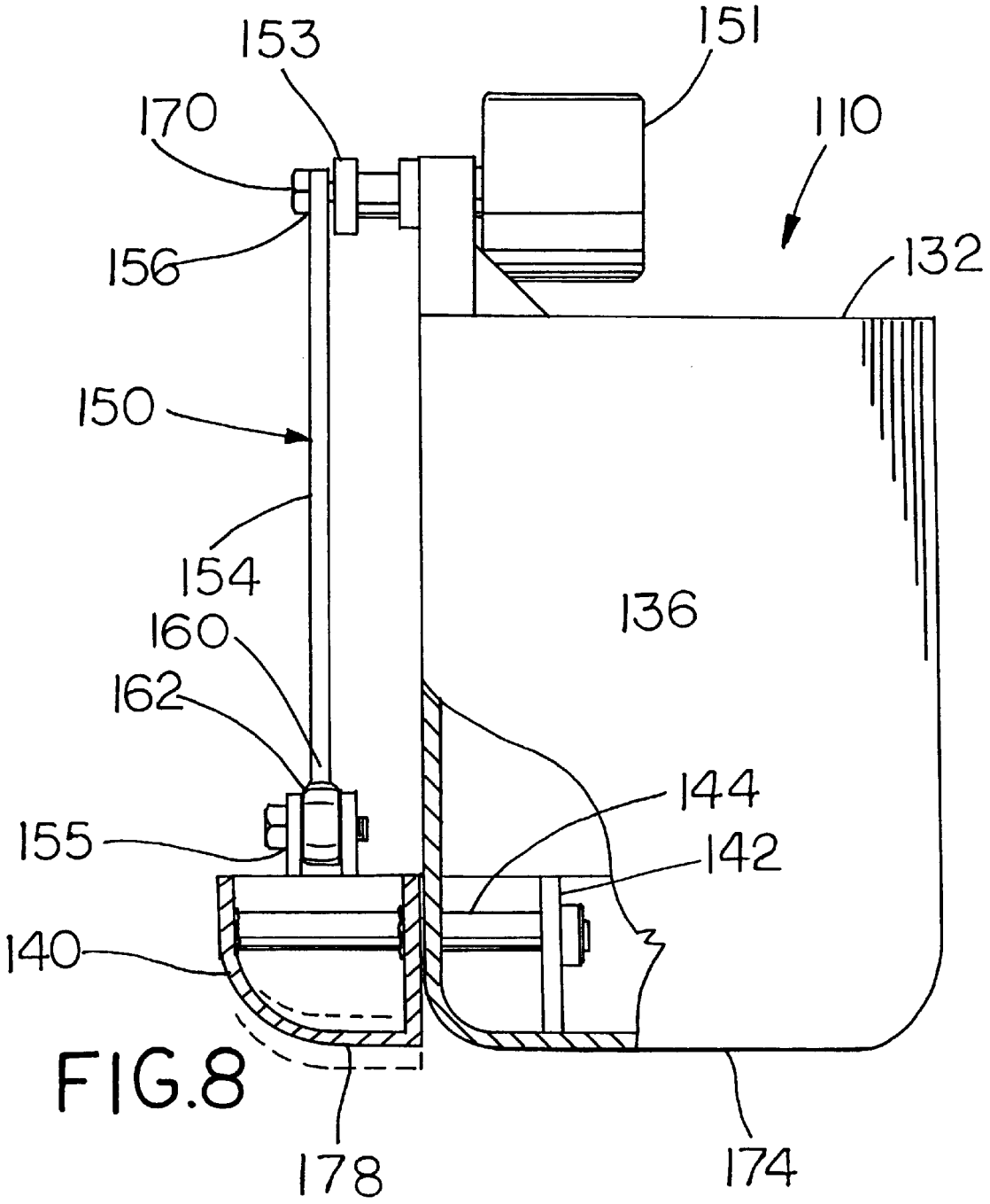
FIG. 8 is a side elevational view taken along lines 8—8 of FIG. 7.

FIGS. 7 and 8 illustrate an alternate embodiment for the present invention. For the sake of simplicity, all components that are the same or similar as in the embodiment discussed above will retain the same reference characters, but the characters will be increased by 100.

An edge compacting device 110 includes a frame member 132 having inner and outer edges 134, 136. The member 132 is adapted to be attached to the adjacent outer end of the adjacent screed or screed extension (not shown) in a conventional manner. The leading edge of the member 132 includes a nose piece or tamping bar 140 which is attached to a trailing portion 142 of the member 132 by a pivot assembly 144. The pivot assembly is disposed generally adjacent an inner edge 146 of the tamping bar 140, while an outer edge 148 of the tamping bar 140 generally overlies, and helps to define, the edge of an asphalt mat (not shown).

An actuation assembly 150 is provided for pivoting or oscillating the tamping bar 140 about the pivot assembly 144, which permits the outer end 148 of the tamping bar to be shifted between a lowered position and a raised position. In the embodiment shown, the actuation assembly includes a drive motor 151 having an eccentric shaft 153. A connecting rod 154 connects the shaft 153 to an attachment assembly 155 at the outer end 148 of the tamping bar 140. Accordingly, the outer end 148 of the tamping bar 140 oscillates or pivots about the pivot assembly 144 in response to rotation of the shaft 153. It will be noted that in the alternate embodiment shown, the axis of the pivot assembly 144 is generally parallel to the path of the paver (not shown). The connecting rod 154 includes an upper end 156 attached to the shaft 153 and also includes a lower end 160 connected to the outer end 148 of the tamping bar 140 by a connection 162. Preferably, the connections at 156 and 162 are ball joints, heim joints, or other suitable connections that will provide two degrees of freedom at the point of connection. Connecting rod 154 may also include a length adjusting mechanism (not shown). The connection at the upper end 156 also includes an adjuster 170, so that the stroke or "throw" of the tamping bar 140 can be adjusted. As shown in FIGS. 7 and 8, the member 132 of the edge compacting device 110 includes a generally planar bottom surface 174, while the tamping bar 140 includes a planar portion 178, which at times is above, coplanar with, or below the bottom surface 174 as the shaft 153 rotates.

It will be understood that the above description does not limit the invention to the precise form disclosed. It is contemplated that various modifications and substitutions can be made without departing from the scope of the following claims.

What is claimed:

1. An edge compacting device for attachment to a screed of an asphalt paver, the paver having a drive system and being adapted to apply a mat of asphalt material as the paver is moved along a path, the edge compacting device comprising:

a frame member for attachment to the screed;

a tamping bar having an inner end attached to the frame member by a pivot and having an outer end generally overlying an edge portion of the asphalt mat; and an actuator for operative connection to the drive system, the actuator being connected to the tamping bar outer end for pivoting the tamping bar about the pivot in response to operation of the drive system, to thereby tamp the edge portion of the asphalt mat as the paver is moved along the path.

2. The device of claim 1, wherein the pivot has an axis, and wherein the axis of the pivot is generally parallel to the path of the paver.

3. The device of claim 1, wherein the actuator includes a rotatable shaft and a connecting rod, the rod having a first end pivotally and eccentrically connected to the rotatable shaft and a second end connected to the tamping bar outer end, whereby the connecting rod reciprocates in response to rotation of the rotatable shaft thereby pivoting the tamping bar about the pivot.

4. The device of claim 3, wherein the connecting rod second end is connected to the tamping bar outer end by a ball joint.

5. The device of claim 1, wherein the member includes an inner portion for attachment to the screed and an outer portion generally adjacent the asphalt mat edge portion, and further including a retention plate mounted to the member outer portion.

6. The device of claim 1, the screed having a leading edge, and wherein the tamping bar is attached to the screed leading edge.

7. The device of claim 1, the screed having a generally planar bottom surface, and wherein the tamping bar outer end includes a bottom surface shiftable between a raised position disposed above the screed bottom surface and a lowered position disposed below the screed bottom surface.

8. The device of claim 3, wherein the connecting rod is adjustable.

9. The device of claim 3, wherein the eccentric connection is adjustable.

10. The device of claim 3, wherein the connecting rod second end includes a ball joint.

11. The device of claim 1, wherein the member includes an outer end generally overlying the edge of the asphalt mat, and including a retention plate attached to the member outer end for defining the edge of the asphalt mat.

12. An asphalt paver for applying a mat of asphalt material as the paver is moved along a path, comprising:

a frame;

a compacting screed attached to the frame and having an outer end;

a screed extension attached to the screed outer end, the screed extension including a pivoting tamping bar having an outer end generally overlying an edge portion of the asphalt mat; and means engaging the tamping bar for oscillating the tamping bar about a pivot axis, thereby compacting the outer edge of the asphalt mat as the paver is moved along the path.

13. The asphalt paver of claim 12, wherein the tamping bar pivot axis is generally parallel to the path of the paver.

14. The asphalt paver of claim 12, wherein the means includes a rotatable shaft, and a connecting rod having a first end attached to the shaft by an eccentric connection and a second end connected to the tamping bar outer end.

15. The asphalt paver of claim 14, wherein the connecting rod is adjustable.

16. The asphalt paver of claim 14, wherein the eccentric connection is adjustable.

17. The asphalt paver of claim 14, wherein the connecting rod second end is connected to the tamping bar outer end by a ball joint.

18. The asphalt paver of claim 12, wherein the frame includes an inner portion for attachment to the screed and an outer portion generally adjacent the asphalt mat edge portion, and further including a retention plate mounted to the frame outer portion.

19. The asphalt paver of claim 12, the screed having a leading edge, and wherein the tamping bar is attached to the screed leading edge.

20. The asphalt paver of claim 12, the screed having a generally planar bottom surface, and wherein the tamping bar outer end includes a bottom surface shiftable between a raised position disposed above the screed bottom surface and a lowered position disposed below the screed bottom surface.

21. The asphalt paver of claim 15, wherein the connecting rod second end includes a ball joint.

22. The asphalt paver of claim 12, wherein the screed extension includes an outer end generally overlying the edge of the asphalt mat, and including a retaining bar attached to the screed extension outer end for defining the edge of the asphalt mat.

23. An asphalt paver for applying a mat of asphalt material as the paver is moved along a path, comprising:

a frame;

a compacting screed attached to the frame and having an outer end, the compacting screed including a rotatable vibrator shaft;

an edge compactor attached to the outer end of the compacting screed, the edge compactor including a pivoting tamping bar having an outer end generally overlying an edge portion of the asphalt mat, a rotatable shaft connected to the vibrator shaft, and a rod eccentrically mounted to the rotatable shaft and secured to the tamping bar outer end for pivoting the tamping bar in response to rotation of the rotatable shaft, the edge compactor thereby compacting the edge portion of the asphalt mat as the paver is moved along the path.

24. The asphalt paver of claim 23, wherein the tamping bar is adapted to pivot about an axis generally parallel to the path of the paver.

25. The asphalt paver of claim 23, wherein the edge compactor includes a connecting rod having a first end pivotally and eccentrically connected to the rotatable shaft and a second end connected to the tamping bar outer end, whereby the connecting rod reciprocates in response to rotation of the rotatable shaft thereby repeatedly oscillating the tamping bar about the pivot.

26. The asphalt paver of claim 25, wherein the connecting rod second end is connected to the tamping bar outer end by a ball joint.

27. The asphalt paver of claim 23, wherein the edge compactor includes an inner portion for attachment to the screed and an outer portion generally adjacent the asphalt mat edge portion, and further including a retention plate mounted to the edge compactor outer portion.

28. The asphalt paver of claim 23, the screed having a leading edge, and wherein the tamping bar is attached to the screed leading edge.

29. The asphalt paver of claim 23, the screed having a generally planar bottom surface, and wherein the tamping bar outer end includes a bottom surface shiftable between a raised position disposed above the screed bottom surface and a lowered position disposed below the screed bottom surface.

30. The asphalt paver of claim 25, wherein the connecting rod is adjustable.

31. The asphalt paver of claim 25, wherein the eccentric connection is adjustable.

32. The asphalt paver of claim 25, wherein the connecting rod second end includes a ball joint.

33. The asphalt paver of claim 23, wherein the edge compactor includes an outer end generally overlying the edge of the asphalt mat, and including a retention plate attached to the edge compactor outer end for defining the edge of the asphalt mat.

34. A screed extension for attachment to a screed of an asphalt paver, the paver for applying a mat of asphalt material as the paver is moved along a path, comprising:

a rigid frame member attached to the paver screed;

a rotatable shaft extending into the rigid frame member and being connected to a drive system;

a nose piece attached to a front end of the rigid frame member by a pivot, the nose piece having an outer end generally overlying an edge portion of the asphalt mat;

a connecting rod eccentrically mounted to the rotatable shaft and secured to the nose piece outer end for oscillating the nose piece about the pivot in response to rotation of the rotatable shaft, whereby the edge portion of the asphalt mat is repeatedly compacted as the paver is moved along the path.

35. An asphalt paver for applying a mat of asphalt material as the paver is moved along a path, comprising:

a frame;

a compacting screed attached to the frame and having an outer end, the compacting screed including a rotatable vibrator shaft;

edge compacting means attached to an outer end of the compacting screed, the edge compactor means including an oscillating tamping bar having an outer end generally overlying an edge portion of the asphalt mat and a retention plate generally defining an outer edge of the asphalt mat, the edge compacting means further including actuation means for oscillating the tamping bar independently of the compacting screed in response to movement of a "oscillating the tamping bar "in response to movement of a drive system as the paver proceeds along the path.

* * * * *

UNITED STATES PATENT AND TRADEMARK OFFICE

CERTIFICATE OF CORRECTION

PATENT NO. : 6,019,544
DATED : February 1, 2000
INVENTOR(S) : Emerson et al.

It is certified that error appears in the above-identified patent and that said Letters Patent is hereby corrected as shown below:

Column 10,
Lines 15-16, delete ""oscillating the tamping bar" in response to movement of a".

Signed and Sealed this

Twenty-fourth Day of May, 2005

JON W. DUDAS
*Director of the United States Patent and Trademark Office*